US008328414B2

(12) United States Patent
Graemiger et al.

(10) Patent No.: US 8,328,414 B2
(45) Date of Patent: Dec. 11, 2012

(54) TIMEPIECE PROVIDED WITH A DEVICE FOR CONTROLLING FUNCTIONS AND/OR TIME INDICATIONS

(75) Inventors: Pierre-Alain Graemiger, Trelex (CH); Arnaud Rosenzweig, Bonneville (FR)

(73) Assignee: Rolex S.A., Geneva (CH)

( * ) Notice: Subject to any disclaimer, the term of this patent is extended or adjusted under 35 U.S.C. 154(b) by 29 days.

(21) Appl. No.: 13/159,082

(22) Filed: Jun. 13, 2011

(65) Prior Publication Data

US 2011/0242947 A1 Oct. 6, 2011

Related U.S. Application Data

(62) Division of application No. 12/164,885, filed on Jun. 30, 2008, now Pat. No. 7,980,756.

(30) Foreign Application Priority Data

Jul. 2, 2007 (EP) ..... 07405188

(51) Int. Cl.
*G04B 27/04* (2006.01)

(52) U.S. Cl. ..... 368/192; 368/184; 368/190

(58) Field of Classification Search ..... 368/184–202
See application file for complete search history.

(56) References Cited

U.S. PATENT DOCUMENTS

| | | | | |
|---|---|---|---|---|
| 360,415 | A | 4/1887 | Byam | |
| 444,511 | A | 1/1891 | Vandegrift | |
| 5,251,533 | A | 10/1993 | Layton | |
| 5,339,297 | A | 8/1994 | Suzuki et al. | |
| 7,441,945 | B2 | 10/2008 | Laucella et al. | |
| 7,517,138 | B2 | 4/2009 | Guyot | |
| 2001/0004618 | A1* | 6/2001 | Hur | 477/107 |
| 2003/0015198 | A1* | 1/2003 | Heeke et al. | 128/204.18 |
| 2003/0151984 | A1 | 8/2003 | Speichinger et al. | |
| 2005/0020728 | A1* | 1/2005 | Nagaswa et al. | 523/160 |
| 2010/0097898 | A1 | 4/2010 | Oppliger et al. | |

FOREIGN PATENT DOCUMENTS

| | | | |
|---|---|---|---|
| GB | 2 081 477 | A | 2/1982 |
| JP | 02-036395 | A | 2/1990 |

OTHER PUBLICATIONS

European Search Report dated Apr. 1, 2008, issued in related European Patent Application EP 07 40 5188.

* cited by examiner

*Primary Examiner* — Sean Kayes
(74) *Attorney, Agent, or Firm* — Westerman, Hattori, Daniels & Adrian, LLP

(57) ABSTRACT

This timepiece is provided with a device for the adjustment of functions and time indications comprising a selection control (L) for each time indication which has to be adjusted and a control (T) for adjustment of the said selected time indications. At least the selection control (L) or the indication which has to be adjusted is kinematically linked with a selection cam ($C_1$) comprising a profile corresponding to two states 0, 1, corresponding to a non-selection state and a selection state respectively, the control device comprising means ($L_1$, $L_2$, $L_3$) for connecting the adjustment control (T) to each of the selected time indications.

21 Claims, 7 Drawing Sheets

Figure 1:
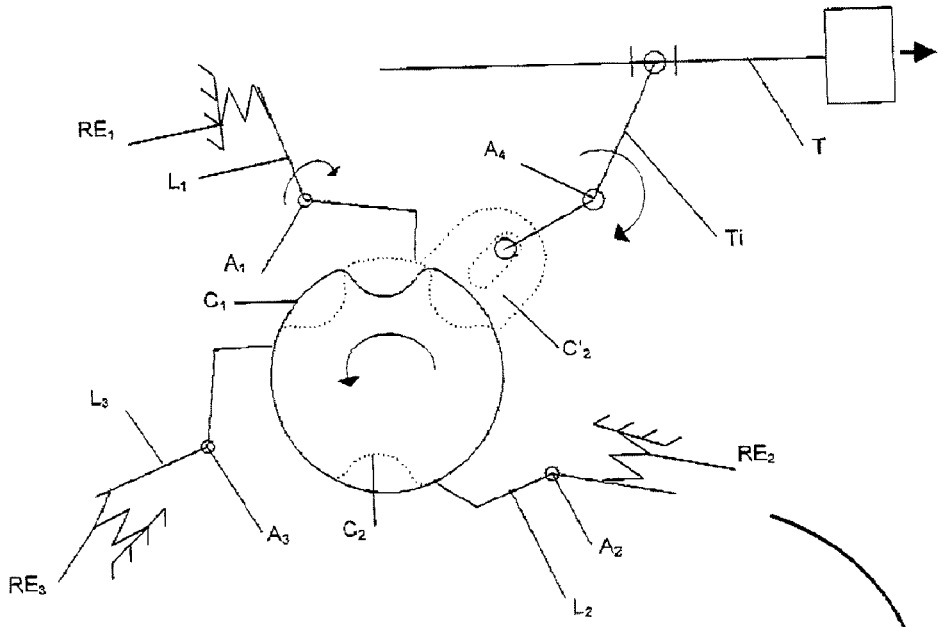

TIMEPIECE PROVIDED WITH A DEVICE FOR CONTROLLING FUNCTIONS AND/OR TIME INDICATIONS

This application is a divisional of U.S. application Ser. No. 12/164,885 filed Jun. 30, 2008, which is hereby incorporated herein by reference in its entirety.

This invention relates to a timepiece provided with a device for controlling functions and/or time indications comprising a control for selecting each function and/or time indication which has to be brought into operation and a control for adjusting the said selected functions or time indications.

Commonly functions and/or time indications are adjusted using the stem. When pushed towards the center of the timepiece, in the case of a mechanical watch, the stem controls rewinding of the spring, and in a second axial position, resulting from being pulled outwards, the stem is caused to engage the movement to adjust the time and minute indications. There are also watches having a day-of-the-month indicator in which the stem can be moved into a third position to adjust the day-of-the-month or day indicator.

This is effectively the limit of the functions and/or the time indications which can be adjusted using only the stem. In fact, even if the number of stem positions could be increased further, users would have difficulty in remembering the function of each position, apart from the fact that it would also be difficult for them to know what position the stem was in. When there are more than two indications which have to be adjusted users have to be informed about the nature of the function and/or time indication which they are adjusting.

It has already been suggested in CH228 that selection of function between rewinding and time setting should be separated from execution of the function, using a turning bezel to control a yoke provided with an intermediate wheel which can engage either the winding ratchet or the movement. The stem which has a fixed axial position is used either to wind or to set the time depending upon the position of the yoke controlled by the bezel. Given that a yoke is used, the number of functions which can be corrected using this solution is obviously very limited. In fact, in the solution described in this document the two-position stem with setting lever and sliding pinion is replaced by a single axial position stem and yoke controlled by the bezel, but the number of functions which have to be adjusted is not increased.

There are several documents which suggest that a turning bezel fitted with annular teeth engaging a radial axis pinion should be used to adjust a time function, either the hour spindle, the date, the day, the month or even the year. One of these arrangements is described in EP 1584000. It should be noted that in this arrangement the bezel can only be used to adjust one of the functions mentioned.

Other arrangements suggest that possibilities for adjusting time indications should be added by adding independent push buttons, which spoil the aesthetics of the watch and therefore necessarily limit the number of indications which can be adjusted in this way.

It has further been proposed that a turning bezel should be used to select the various time settings in JP2036395 or U.S. Pat. No. 4,253,177, but the indications adjusted are selected through an electronic control, which rules out any application outside the field of electronic watches.

Finally, U.S. Pat. No. 360,415 discloses a winding and time setting mechanism in which the stem has only one degree of freedom in rotation, passage from the winding position to the time setting position being carried out by means of a cam acting on a yoke. Such a system only allows a choice between the control of two functions and/or time indications. Now the object of this invention is to make it possible to increase the number of functions and/or time indications which can be controlled.

It is clear that the setting of several functions and/or time indications poses a problem for which it is difficult to find a satisfactory solution.

The object of this invention is to at least partly overcome the disadvantages of known solutions.

For this purpose this invention relates to a timepiece fitted with a function and/or time indication adjustment device provided with a device for controlling at least 3 functions and/or time indications comprising a control for selecting each function and/or time indication which has to be adjusted and a control for the said selected functions and/or time indications, wherein a kinematic link is provided between at least the control for selection of the function and/or time indication requiring adjustment and a selection cam whose profile comprises $n \geqq 2$ times two states 0, 1 corresponding respectively to a non-selection state and a selection state, the adjustment device comprising means for linking the control to each of the selected functions and/or time indications.

Preferably the setting control is in kinematic connection with a second cam comprising a profile having n ($n \geqq 2$) times two states 0, 1 respectively corresponding to a non-adjustment state and an adjustment state, the adjustment device comprising means to detect concordance between the two states 1 on the two respective cams.

The advantages of this timepiece equipped with this adjustment device essentially derive from the separation of selection and setting. Correction is only possible if the function and/or indication which has to be adjusted is selected, that is there must be concordance between the two states 1 of the two cams in the case of the preferred embodiment. The order in which the cams are activated is of no consequence.

Advantageously, the function and/or indication which is to be adjusted is selected using a rotating bezel. Because of this the number of functions and/or indications which are to be adjusted can be high, as the bezel can rotate through 360°. Each function and/or indication which it is desired to adjust can therefore be advantageously identified by moving a reference mark on the rotating bezel opposite to a fixed indication corresponding to the function and/or indication which has to be adjusted. Thus users always know what action they will carry out using the setting control.

Advantageously, the setting control comprises a two-position stem, one position of which is a winding position and the second position of which is an adjustment position. Thus a single two-position stem can be used to adjust a number of functions and/or time indications which is substantially greater than its single adjustment position.

Furthermore, as adjustment is selected by the control selecting the function and/or time indication which has to be adjusted, the stem no longer needs to be associated with a sliding pinion and can advantageously be associated with a disengaging system which axially separates two co-axial moving parts of the winding movement. Elimination of the sliding pinion also makes it possible to avoid the risks of sticking between the sliding pinion and the movement.

Preferably the means for detecting concordance between the two states 1 on the two cams, in the preferred embodiment, can be activated by means of springs and not by means of a force transmitted by the stem adjusting the selected functions and/or time indications.

It would appear that this timepiece equipped with this adjustment device is above all highly reliable and easy to use, even though the number of functions and/or indications which have to be adjusted is substantially greater than in most watches in the state of the art.

The appended drawings diagrammatically illustrate explanatory diagrams and a preferred embodiment of the timepiece to which the invention relates, by way of example.

Figure 2:
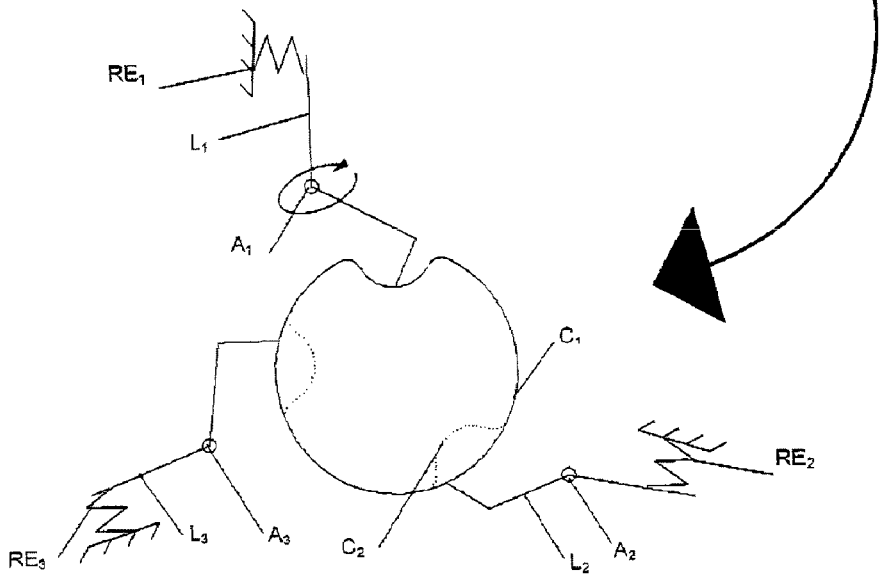
Figure 3:
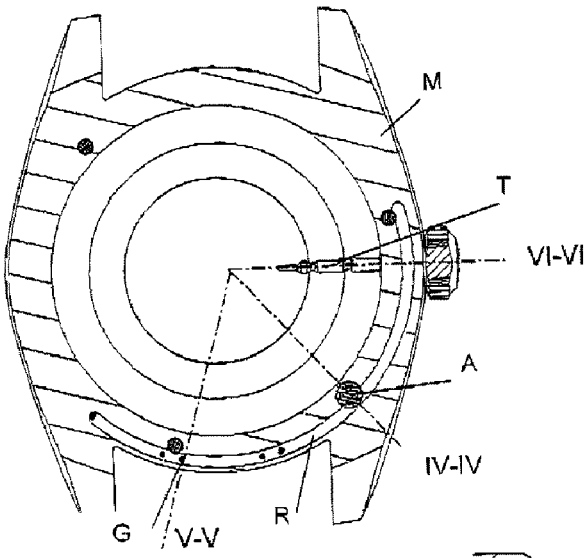
Figure 4:
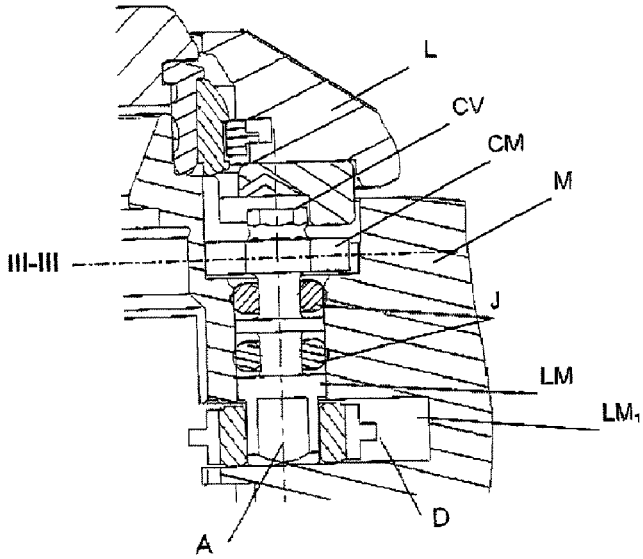
Figure 5:
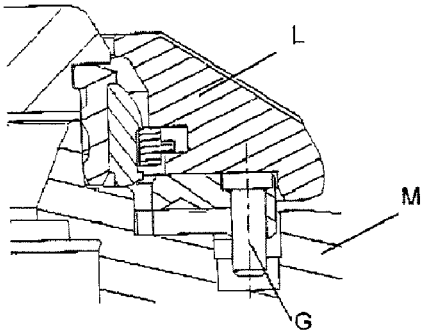
Figure 6:
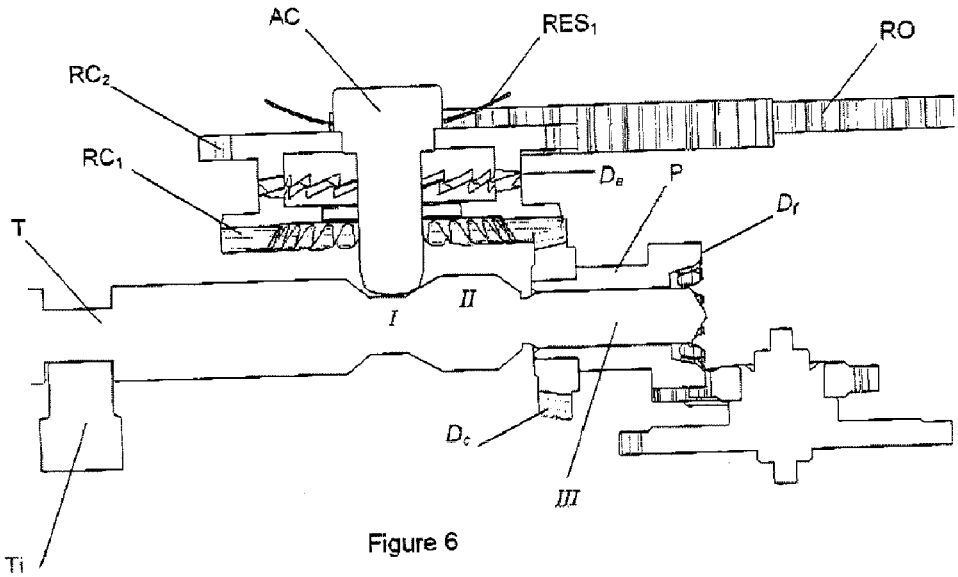
Figure 7:
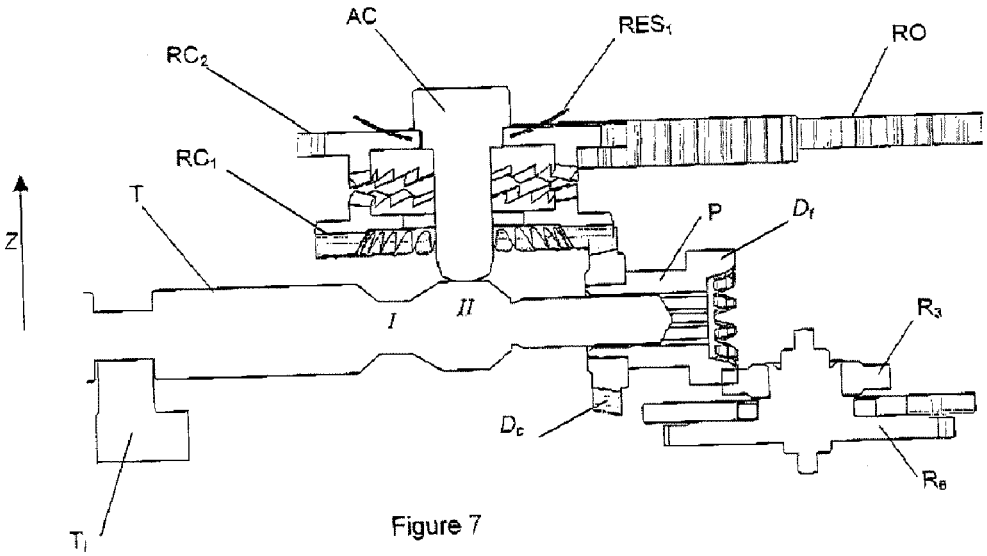
Figure 8:
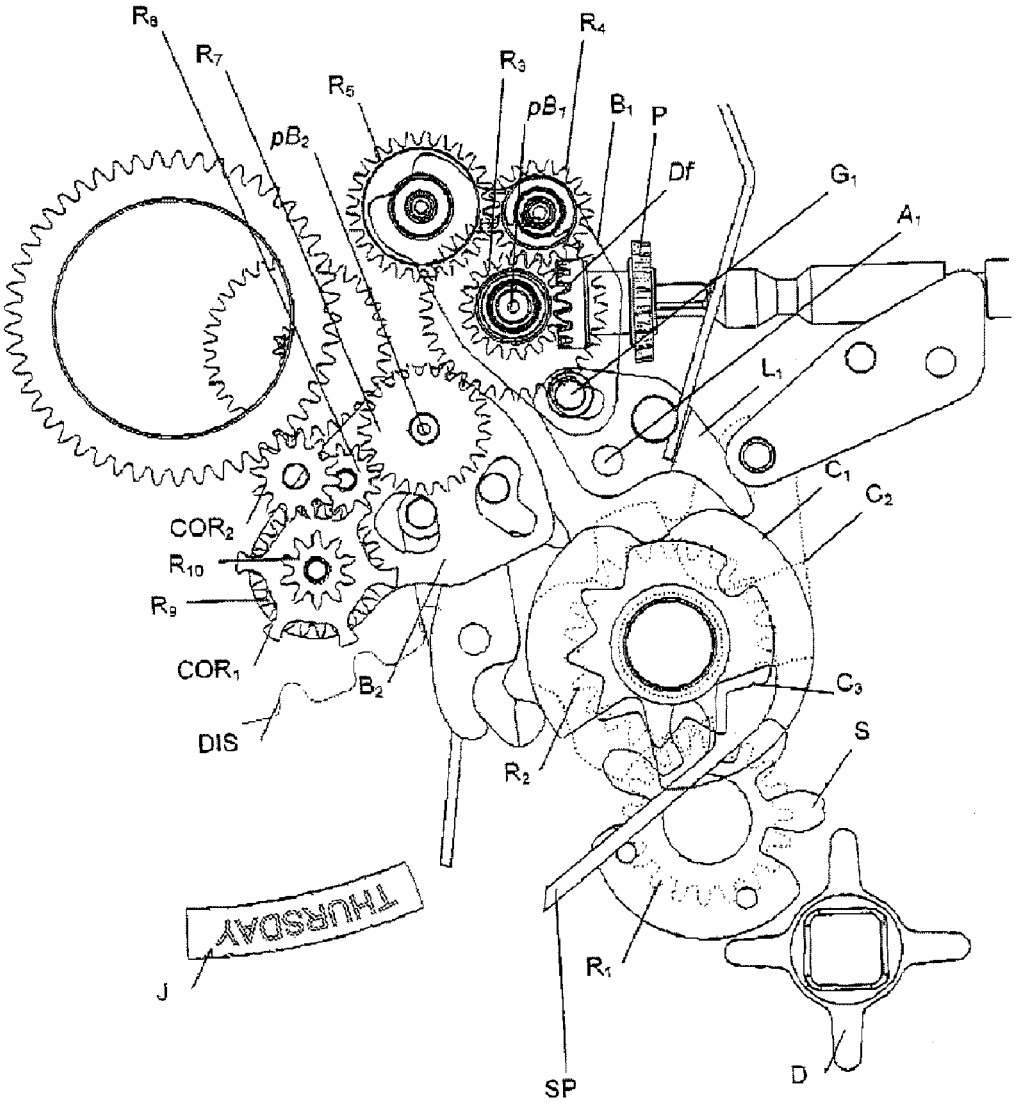
Figure 9:
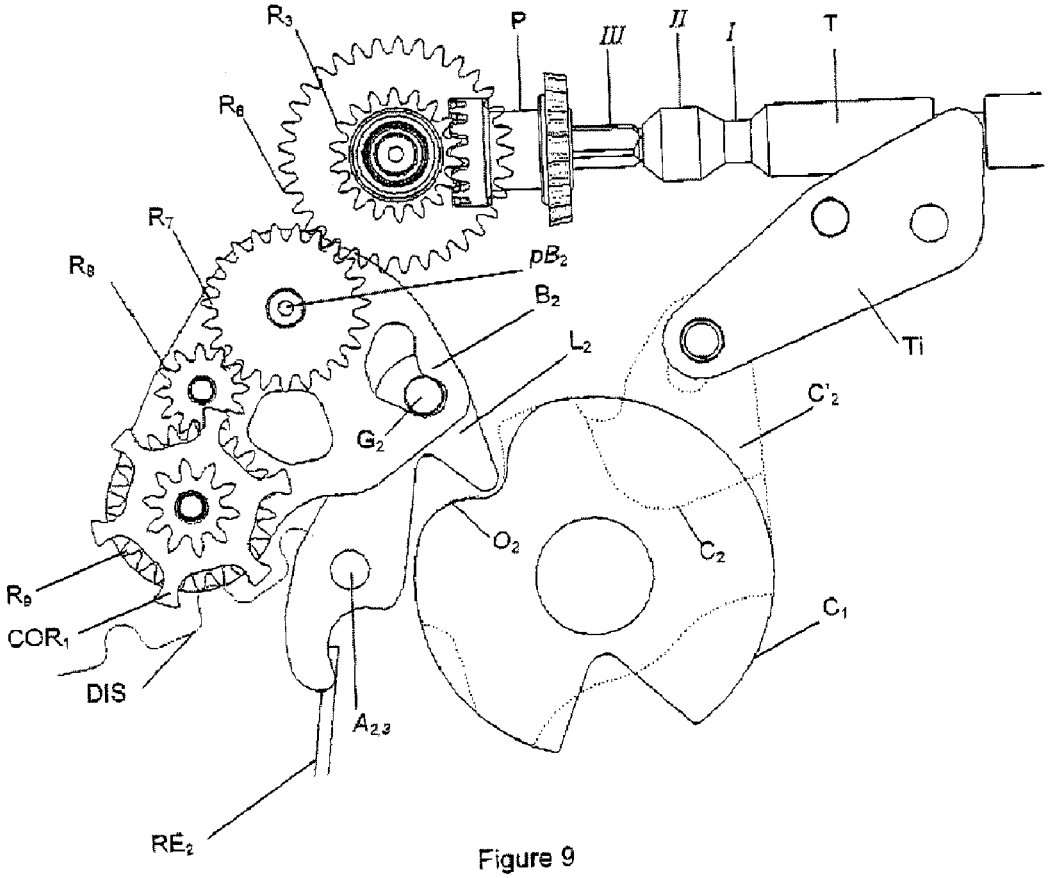
Figure 10:
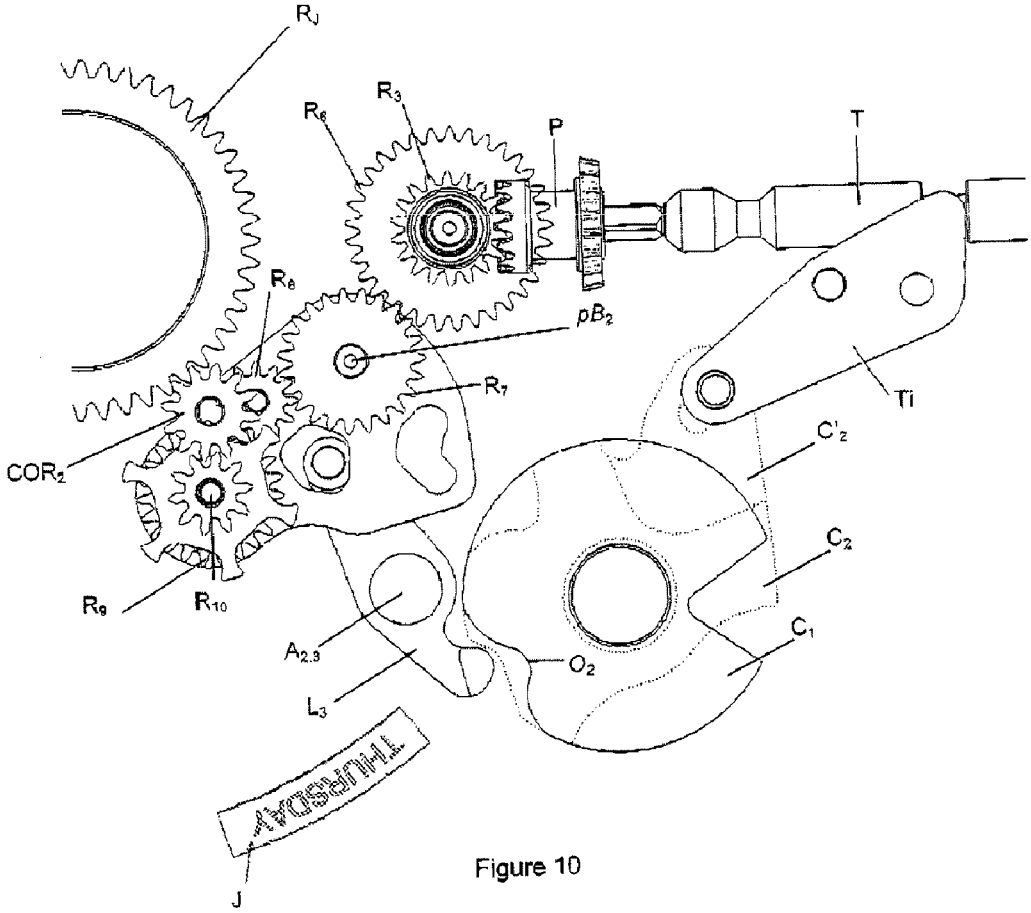
Figure 11:
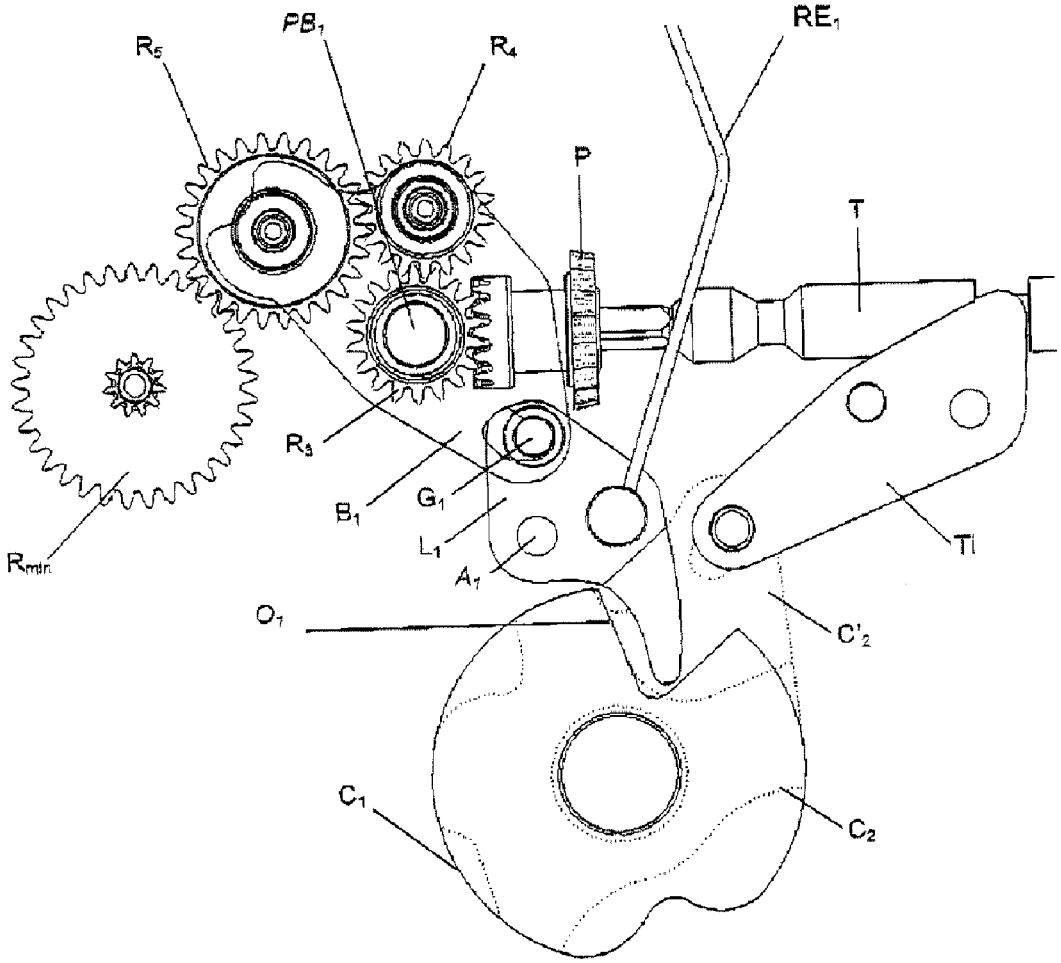

FIGS. 1 and 2 are diagrams illustrating the principle of operation of the adjustment device, FIG. 3 is a plan view of a casing for the timepiece to which the invention relates with a cross-section along the line III-III in FIG. 4, FIG. 4 is a cross-sectional view along the line IV-IV in FIG. 3, FIG. 5 is a cross-sectional view along the line V-V in FIG. 3, FIG. 6 is a cross-sectional view of the winding mechanism along the line VI-VI in FIG. 3, only the stem of this rewinding mechanism being visible in FIG. 3, FIG. 7 is a view similar to FIG. 6 showing the winding mechanism in a second position, FIG. 8 is a plan view on the side of the face of the timepiece showing the entire function and/or time indication adjustment device in the preferred embodiment of the timepiece, in a resting position, FIG. 9 is a partial view of the adjustment device in FIG. 8, showing this device in the position for adjusting the day-of-the-month indications, FIG. 10 is a partial view of the adjustment device in FIG. 8 showing the device in the position for setting the indications of the days-of-the-week, FIG. 11 is a partial view of the adjustment device in FIG. 8 showing the device in the position for adjusting the time.

The general concept of the adjustment device is illustrated very diagrammatically in FIGS. 1 and 2. According to this concept the device comprises at least one selection cam $C_2$ which has a binary profile having n ($n \geqq 2$) times two states 0 and 1. In the example illustrated, in which selection cam $C_2$ is mounted to pivot about an axis of rotation, level 0 forms a circular surface centered on the axis of rotation corresponding to a non-selection state, whereas level 1 forms at least two hollows in the circular surface corresponding to selection states.

In the example considered, the adjustment device is designed to adjust three different time indications, each comprising means which bear against cam $C_2$ to connect the time indication requiring adjustment to an adjustment control. In the diagrammatical illustration in FIGS. 1 and 2 the above-mentioned means are illustrated in the form of levers $L_1$, $L_2$, $L_3$ mounted to pivot about axes $A_1$, $A_2$ and $A_3$ respectively and pressed against selection cam $C_2$ by return springs $RE_1$, $RE_2$ and $RE_3$ respectively. Means which are not shown in FIGS. 1 and 2 but which are illustrated subsequently are intended to make it possible to move selection cam $C_2$ angularly to selectively bring its hollow corresponding to state 1 opposite one of levers $L_1$, $L_2$, $L_3$ in order to connect the selected function or time indication to an adjustment control.

In the preferred embodiment of this invention provision has been made for use of a stem T having two axial positions, one axial position pushed towards the movement of the timepiece, corresponding to the conventional position for winding the barrel spring in the case of a mechanical timepiece, and an axial position in which stem T is pulled outwards, corresponding to the conventional position for setting the time, for use as the control member. However, in the case of this invention this second position corresponds to a position for adjusting one of the functions or time indications which have been or will be selected.

The winding mechanism associated with stem T will be described in detail below. For the time being it is sufficient to state that this stem T is in desmodromic connection with a second cam $C_2$ which in this example is a cam of generally circular shape concentric with selection cam $C_1$. The desmodromic link between cam $C_2$ and stem T is provided by a setting lever Ti which is mounted so as to pivot about an axis $A_4$, one arm of which is engaged with stem T, while the other arm has a pin which is mounted with play in an elongated opening in an arm $C_2'$ which is of one piece with cam $C_2$.

This cam $C_2$ comprises n ($n \geqq 2$) times two states 0 and 1, but here it comprises as many states 1 formed by the hollows as there are functions or time indications which have to be adjusted. These hollows corresponding to states 1 are set apart at angular distances from each other corresponding to the respective angular distances separating the extremities of levers $L_1$, $L_2$, $L_3$ bearing against selection cam $C_1$ and simultaneously against cam $C_2$, the circular parts of these two cams corresponding to states 0 having the same radius. Depending upon the axial position of stem T, cam $C_2$ can therefore occupy two angular positions about the axis of rotation of cams $C_I$, $C_2$, one corresponding to stem T in the pushed-in axial position, in which the hollows of states 1 of cam $C_2$ are not opposite the extremities of corresponding levers $L_1$, $L_2$, $L_3$, the other corresponding to the position of stem T in the pulled-out position in which the hollows of states 1 of cam $C_2$ are opposite the corresponding extremities of levers $L_1$, $L_2$, $L_3$. However, given that levers $L_1$, $L_2$, $L_3$ bear simultaneously against the two cams $C_1$, $C_2$, this second angular position of cam $C_2$ is not sufficient to make it possible to adjust a function or time indication. In fact, in order for such adjustment to be possible two hollows, corresponding to states 1 for the two cams $C_1$, $C_2$ must be in a coincident angular position and must be opposite the extremity of one of levers $L_1$, $L_2$, $L_3$. Thus when the hollows of states 1 of cam $C_2$ are opposite the extremities of the different levers $L_1$, $L_2$, $L_3$, it is sufficient to rotate selection cam $C_1$ to bring its hollow state 1 opposite lever $L_1$, $L_2$, $L_3$ corresponding to the function or time indication which it is desired to adjust. On passage from one adjustment position to the other all levers $L_1$, $L_2$, $L_3$ pass through state 0.

Now that the general principle of the device for adjusting time indications has been described, a preferred embodiment of the invention in which the function or indication which is to be adjusted is selected by a rotating bezel L (FIGS. 4 and 5) mounted on a watch case of the timepiece according to the invention will now be described. The upper surface of middle M of this watch case adjacent to the lower surface of bezel L comprises a groove in the shape of an arc of a circle R (FIG. 3) centered on the center of middle M, coinciding with the center of rotation of rotating bezel L. A control shaft A is mounted in a cylindrical housing LM in middle M. The longitudinal axis of this cylindrical housing LM, which is the same as that of control shaft A, is perpendicular to the plane of rotation of rotating bezel L. Two O-ring seals J are located between control shaft A and the wall of cylindrical housing LM. The upper extremity of the shaft ends in a locking square CV which is intended to prevent free rotation of control shaft A. A Maltese cross CM is fixed below locking square CV and is intended to be driven through 2×90° when pairs of drive pins G which are angularly distributed on rotating bezel L come to engage Maltese cross CM. The position of each pair of pins G corresponds to a selected time indication requiring adjustment. As a consequence, a reference mark can be fixed on rotating bezel L and information relating to the selected time indications requiring adjustment can be located on the face or on a raised portion surrounding the face for example, so that it is possible to know what selection or non-selection position rotating bezel L is in.

The other extremity of control shaft A enters a part $LM_1$ of housing LM for middle M which opens onto the inner lateral surface of middle M. This other extremity of control shaft A is of one piece with a pinion fitted with four arms D which in turn penetrate within middle M to drive the arms of a selector S (FIGS. 8 to 11) of the device for adjusting the time indications. This selector S is of one piece with a intermediate wheel $R_1$ engaging a intermediate wheel $R_2$ which is of one piece with selection cam $C_1$ and a positioning cam $C_3$.

The winding mechanism controlled by stem T and which in this example also comprises the adjustment control will now be described in greater detail with reference more particularly to FIGS. 6 and 7.

Stem T engages an arm of setting lever Ti, as explained previously. Its inner extremity has a section III of polygonal shape matching that of the axial opening of a pinion of intermediate wheel P of generally cylindrical shape of which a frontal tooth $D_f$ engages with a intermediate wheel $R_3$ of one piece with a first moving intermediate wheel $R_6$ of the movement. Winding pinion P also has an angled tooth $D_c$ engaging with an angled tooth of a winding crown $RC_1$ provided with a Breguet bevel tooth $D_a$ engaging the Breguet bevel tooth $D_a$ of a second winding cam $RC_2$ which is of one piece with the shaft of crown AC and is pressed axially against the first wheel of crown $RC_1$ by a spring $RES_1$. This second winding crown $RC_2$ forms a moving part of the engagement of an engaging mechanism between stem T and the winding gear train.

To control this engaging mechanism one extremity of the shaft of crown AC is pressed by spring $RES_1$ against a first portion I of smaller diameter of stem T when this is in its pushed-in position corresponding to its winding position (FIG. 6). This first portion I is connected by means of a frustoconical surface to a second portion II of larger diameter, so that when stem T is pulled outwards the shaft of crown AC is raised against the pressure of return spring $RES_1$ in such a way that the two Breguet bevel teeth $D_a$ are separated from each other, interrupting the kinematic link between stem T and barrel sprocket RO.

It will be noted that unlike conventional winding mechanisms, winding pinion P is not a sliding pinion, only stem T slides within pinion P which is fixed in relation to the longitudinal axis of stem T. This means that the first moving part $R_3$, $R_6$ of the adjustment movement is constantly engaged, regardless of the axial position of stem T. In the position in which stem T is pulled out (FIG. 7) setting lever Ti has moved cam $C_2$ into the position illustrated by FIGS. 9-11, which means that the three hollows corresponding to state 1 of cam $C_2$ are respectively located opposite the extremities of levers $L_1$, $L_2$, $L_3$. However these cannot be driven into these hollows by springs $RE_1$, $RE_2$, $RE_3$ until the hollow of selection cam $C_1$ is caused to coincide with one of the hollows in cam $C_2$. As explained previously, selection cam $C_1$ is brought into engagement by turning rotating bezel L and the pairs of pins G which engage Maltese cross CM of one piece with control shaft A, which has the effect of causing the arms of selector S (FIG. 8), which is of one piece with intermediate wheel $R_1$, to engage with intermediate wheel $R_2$ which is of one piece with selection cam $C_1$. Positioning member $C_3$, which is of one piece with selection cam $C_1$, engages a positioning catch SP and serves to hold selection cam $C_3$ in the position corresponding to control of the selected function or time indication adjustment.

We will now explain how the kinematic link between stem T in the pulled-out position illustrated in FIGS. 9-11 and the various time indications selected for adjustment is provided.

FIG. 8 illustrates the various members of the adjustment device in a position in which no adjustment can be performed. The adjustment device has two yokes $B_1$ and $B_2$ which pivot about axis $PB_1$, $PB_2$ respectively. Yoke $B_1$ is the time setting yoke and has three intermediate wheels, intermediate wheel $R_3$ concentric with pivot axis $PB_1$ of this yoke $B_1$ and constantly engaged with front tooth $D_f$ of winding pinion P and intermediate wheels $R_4$, $R_5$. This yoke $B_1$ is connected to lever $L_1$ by an articulation $G_1$, lever $L_1$ being mounted so as to pivot about an axis $A_1$.

Yoke $B_2$ has four intermediate wheels, intermediate wheel $R_7$ coaxial with pivot axis $PB_2$, which is constantly engaged with intermediate wheel $R_6$ which is coaxial and of one piece with intermediate wheel $R_3$, intermediate wheel $R_8$ which engages intermediate wheel $R_7$ and a intermediate wheel $R_9$ which is coaxial and of one piece with a intermediate wheel $R_{10}$ and a day-of-the-month correction control, $COR_1$. This day-of-the-month correction control $COR_1$ is intended to engage the inner tooth of a day-of-the-month disk DIS in a tilted position of yoke $B_2$, whereas intermediate wheel $R_{10}$ is designed to engage a day of the week correcting intermediate wheel $COR_2$, which engages a day wheel $R_j$ of one piece with a disk bearing the names of the days J, in another position of yoke $B_2$.

FIG. 9 more particularly illustrates the part of the adjustment device relating to adjustment of the day-of-the-month disk DIS. Lever $L_2$ which is mounted so as to pivot about a pin $A_{2,3}$ is pressed by spring $RE_2$ into the hollows of cams $C_1$, $C_2$ whose angular positions have been caused to coincide. The three hollows in cam $C_2$ have been positioned opposite the three levers $L_1$, $L_2$, $L_3$ by stem T in the pulled-out position and the hollow $O_2$ of selection cam $C_1$ has been brought to be opposite the adjacent extremity of lever $L_2$. Given that one hollow in each cam $C_1$, $C_2$ has the same angular position opposite the adjacent extremity of lever $L_2$, the latter pivots about its pivot axis $A_{2,3}$ under the pressure exerted by spring $RE_2$. As it pivots pin $G_2$ of the lever causes yoke $B_2$ to move into the position illustrated in FIG. 9, in which the arms of correction moving unit $COR_1$ penetrate the inner teeth of day-of-the-month disk DIS. As a consequence, the rotation of stem T is transmitted to correction moving part $COR_1$ which can cause day-of-the-month disk DIS to move in one direction or the other.

FIG. 10 more particularly illustrates the part of the adjustment device relating to the adjustment of days-of-the-week disk J. Cam $C_2$ is still in the position corresponding to stem T pulled out with the crowns of intermediate wheels $RC_1$, $RC_2$ disengaged (position illustrated in FIG. 7). Selection cam $C_2$ is moved with the help of rotating bezel L into the angular position illustrated in FIG. 10, in which hollow $O_2$ is opposite the adjacent extremity of lever $L_3$ coinciding with a hollow in cam $C_2$. This makes it possible for lever $L_3$ to tilt under the pressure of spring $RE_3$. In this position yoke $B_2$ becomes free to pivot about its axis $PB_2$. As a consequence, when stem T is caused to rotate clockwise about its axis, intermediate wheel $R_9$ also turns clockwise so that a torque is transmitted to yoke $B_2$ to cause this also to turn clockwise, thus causing intermediate wheel $R_{10}$ to engage with correction intermediate wheel $COR_2$, which drives day wheel $R_j$ in a clockwise direction. The day correction can therefore only be made in this direction because in the reverse direction yoke $B_2$ turns anticlockwise. However, it is stopped by pin $G_2$ which is of one piece with lever $L_2$ so that the arms of day-of-the-month correction moving member $COR_1$ cannot come into contact with the teeth of day-of-the-month disk DIS.

FIG. 11 illustrates the part of the adjustment device intended for setting the time. In the embodiment described in this example a second selection hollow $O_1$ has been provided on selection cam $C_1$ which is used only for setting the time, in order to reduce the angle of rotation of rotating bezel L. When this hollow $O_1$ is placed in the angular position illustrated in FIG. 11, which corresponds to a hollow of cam $C_2$ controlled by stem T, the adjacent extremity of lever $L_1$ is pressed into the superimposed hollows of cams $C_1$, $C_2$ so that it tilts about its pivot axis $A_1$, causing time adjustment yoke $B_1$ to tilt in an anticlockwise direction, engaging intermediate wheel $R_5$ with wheel $R_{min}$ of the movement, making it possible to adjust the hour and minute hands.

It is obvious that the number of functions and/or indications which can be controlled using the control device is not limited to that in the example described. Other adjustments could be added, the principle always being that of a selection cam having two states 0, 1 which can be moved in relation to the various means provided to connect the adjustment control to the time indication which has to be adjusted when a state 1 of the cam is positioned in such a way that these means can pass from their state 0 to their state 1.

As has been seen in the explanation relating to the principle of the invention, cam $C_2$ is only necessary insofar as the control member is a two-position control, as in the example described where the stem which normally has two degrees of freedom in rotation and translation is used simultaneously as an adjustment control in its rotational degree of freedom and as a selection control in its axial translational degree of freedom. A second cam which to some extent plays the part of a mechanical switch is therefore required. If cam $C_2$ is in one position, no adjustment is possible so as not to interfere with the other function of stem T. If cam $C_2$ is in its other position, all adjustments are possible, the selector making it possible to select between the possible adjustments, which is what is desired.

Thus it is possible to have only selection cam $C_1$ and two separate controls, one solely for winding and the other solely for adjusting the time indications selected. If these controls are two stems, they have only one axial position and the mechanism for disengaging the crowns of intermediate wheels $RC_1$, $RC_2$ can be dispensed with. These two stems could be either separated by an angle about middle M, or also mounted coaxially with each other, each fixed to a known drive button known as the winding crown, the two crowns being adjacent to each other along the axis of the winding and adjustment stems.

In the case of a control device having a single selection cam $C_1$ it would also be possible to have only one control, for example a rod of the stem type in a single axial position. In this case winding would correspond to one of the functions selected by selection cam $C_1$.

Although the use of a rotating bezel for controlling selection cam $C_1$ has been illustrated, there is nothing to prevent the use of a rod of the stem type to effect control of this selection cam.

Other modifications could be envisaged. Likewise, all kinds of functions and/or time indications which are capable of being adjusted by the adjustment device of the timepiece to which the invention relates can also be envisaged. Thus changes in the time spindles can be adjusted in the same way.

It is furthermore obvious from the above description that the timepiece according to the invention may also be either mechanical or electronic.

The invention claimed is:

1. Timepiece provided with a device for controlling at least two functions and/or time indications, comprising a selection control for selecting each function and/or time indication which has to be adjusted, an adjustment control for adjusting said selected functions and/or time indications, a selection cam, wherein a kinematic link is provided between at least the selection control and the selection cam, wherein the selection cam comprises n 2 times two states 0, 1, wherein the 0 state corresponds to a non-selection state and the state 1 corresponds to a selection state, and linking means for linking the adjustment control to each of the selected functions and/or time indications, wherein a different kinematic chain is provided between the adjustment control and each of the selected functions and/or time indications, wherein selective positioning in each of the respective states 1 of the selection cam determines selective linking by the linking means of the adjustment control to each of the respective selected functions and/or time indications, whereas selective positioning in each of the states 0 of the selection cam determines the absence of selective linking by the linking means of the adjustment control to each of the respective selected functions and/or time indications, and wherein the selection cam has at least one stable resting position with selective positioning in each of the states 0 of the selection cam, so that the linking means of the adjustment control is not linked to any of the respective selected functions and/or time indications.

2. Timepiece as claimed in claim 1, further comprising a second cam, wherein the second cam has $n \geqq 2$ times two states 0, 1 respectively corresponding to a non-adjustment state and an adjustment state, and wherein the means for linking the adjustment control to the selected functions and/or time indications comprise means for detecting concordance between each of the respective states 1 of the selection cam and at least one of the respective states 1 of the second cam.

3. Timepiece as claimed in claim 1, wherein the adjustment control has one degree of freedom in rotation and one degree of freedom in axial translation through which it is desmodromically linked with the second cam, and wherein selective positioning of the second cam in at least one of the respective states 1 of the second cam determines concordance of each of the respective states 1 of the second cam with a respective one of the states 1 of the selection cam.

4. Timepiece as claimed in claim 3, wherein the two cams are mounted so as to pivot about a common axis.

5. Timepiece as claimed in claim 3, wherein the adjustment control desmodromically linked with the second cam is a stem having two axial positions, wherein one of said positions corresponds to winding, and the other of said positions corresponds to adjustment of the selected time indications, this stem having a portion of non-circular cross-section mounted so as to slide through a cylindrical intermediate pinion provided with teeth at each extremity constantly engaging (i) with a toothed moving part of a gear train of the correction device, and (ii) with a toothed moving part of a winding gear train, this stem also comprising two adjacent portions of different diameters connected together by a frustoconical surface engaging a shaft which is of one piece with an engagement moving part so that the stem can be disengaged from the winding gear train when the stem is in its position for adjusting one of the selected functions and time indications.

6. Timepiece as claimed in claim 1, wherein a casing of the timepiece is provided with a rotating bezel used as the selection control for each of the selected functions and/or time indications.

7. Timepiece as claimed in claim 6, wherein the rotating bezel bears a reference mark while a fixed part adjacent to the rotating bezel has indications to identify what selection position the rotating bezel is in.

8. Timepiece as claimed in claim 6, wherein a middle of the timepiece casing comprises a housing having a longitudinal axis perpendicular to the plane of rotation of the rotating bezel used as a selection member, a control shaft received in the housing, wherein an extremity of the control shaft adjacent to the rotating bezel bears a Maltese cross and the other extremity located in a part of the housing which opens onto the inner surface of the middle bears a pinion desmodromically linked to the selection cam, the rotating bezel comprising engaging elements which are angularly distributed in order to engage the Maltese cross in specific respective angular positions.

9. Timepiece as claimed in claim 8, wherein the rotating bezel bears a reference mark while a fixed part adjacent to the rotating bezel has indications to identify what selection position the rotating bezel is in.

10. Timepiece as claimed in claim 1, wherein one of the selection states of the selection cam corresponds to the winding function of the control.

11. Timepiece as claimed in claim 1, wherein the selection cam has a binary profile.

12. Timepiece as claimed in claim 11, wherein the selection cam comprises $n \geqq 3$ times two states 0, 1.

13. Timepiece as claimed in claim 11, wherein the selection cam is a rotating cam.

14. Timepiece as claimed in claim 13, wherein the selection cam comprises $n \geqq 3$ times two states 0, 1.

15. Timepiece as claimed in claim 13, wherein the selection cam has a circular surface centered on an axis of rotation of the selection cam, the selective angular positioning of the circular surface defining the states 0, and a hollow in the circular surface, the selective angular positioning of the hollow defining the states 1.

16. Timepiece as claimed in claim 15, wherein the selection cam comprises $n \geqq 3$ times two states 0, 1.

17. Timepiece as claimed in claim 1, wherein the selection cam is a rotating cam.

18. Timepiece as claimed in claim 17, wherein the selection cam comprises $n \geqq 3$ times two states 0, 1.

19. Timepiece as claimed in claim 17, wherein the selection cam has a circular surface centered on an axis of rotation of the selection cam, the selective angular positioning of the circular surface defining the states 0, and a hollow in the circular surface, the selective angular positioning of the hollow defining the states 1.

20. Timepiece as claimed in claim 19, wherein the selection cam comprises $n \geqq 3$ times two states 0, 1.

21. Timepiece as claimed in claim 1, wherein the selection cam comprises $n \geqq 3$ times two states 0, 1.

* * * * *

UNITED STATES PATENT AND TRADEMARK OFFICE

CERTIFICATE OF CORRECTION

PATENT NO. : 8,328,414 B2
APPLICATION NO. : 13/159082
DATED : December 11, 2012
INVENTOR(S) : Pierre-Alain Graemiger et al.

It is certified that error appears in the above-identified patent and that said Letters Patent is hereby corrected as shown below:

In the Claims, Column 8, Lines 11-12

Change

"wherein the selection cam comprises n 2 times two states 0, 1,"

to be

-- wherein the selection cam comprises $n \geq 2$ times two states 0, 1, --

Signed and Sealed this
Third Day of September, 2013

Teresa Stanek Rea
*Acting Director of the United States Patent and Trademark Office*